United States Patent [19]

Grossmann

[11] 4,138,138

[45] Feb. 6, 1979

[54] SNOW SKI BRAKE

[76] Inventor: Peter K. Grossmann, 15304 NE. 6th Pl., Bellevue, Wash. 98007

[21] Appl. No.: 840,608

[22] Filed: Oct. 11, 1977

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,899,185 | 8/1975 | Martin | 280/605 |
| 3,930,659 | 1/1976 | Salomon | 280/605 |
| 4,061,356 | 10/1976 | Salomon | 280/605 |
| 4,063,751 | 12/1977 | Salomon | 280/605 |
| 4,066,276 | 1/1978 | Salomon | 280/605 |

*Primary Examiner*—Joseph F. Peters, Jr.
*Assistant Examiner*—Gene A. Church
*Attorney, Agent, or Firm*—Roy E. Mattern, Jr.

[57] ABSTRACT

A snow ski brake becomes effective to stop a ski, after a skier falls and his or her boot is released and cleared from a ski binding, otherwise unintentionally starting a ski on a free runaway downhill run. The free run of the ski however, doesn't occur, because a plow like braking arm, originally held upright over the ski and at a right angle to the ski top, adjacent the ski boot heel plate, under spring force, immediately pivots through 180° in a transverse plane about a horizontal axis, thereby projecting downwardly at a right angle to the ski bottom and becoming an excellent snow plow to stop the ski within a reasonably short distance. In one embodiment, the plow like braking arm is first held in its inactive position by having its transverse or lateral latching bar, which is secured to it at ninety degrees, held transversely adjacent the ski top by a spring biased catch. Then when a skier steps into his or her binding the plow like braking arm is then held in its inactive position only by the skier's boot for the boot upon entering the binding also depresses and releases the spring biased catch. Thereafter the snow ski brake is ready for immediate release, if the ski boot is released and cleared from the binding. In another embodiment, movements of a ski binding are utilized to perform the function of the spring biased catch.

5 Claims, 13 Drawing Figures

SNOW SKI BRAKE

BACKGROUND OF THE INVENTION

The preferred specifications for a ski brake, as presented in issues of Skiing magazine, October 1975 and October 1976, indicate a ski brake should: stop the ski in less distance than the fallen skier will slide; stop the ski whether it is sliding forward, backward, or sideways; stop the ski regardless of slope steepness, snow conditions, or speed; not in itself be a hazard to the skier or other skiers on the slope, be unaffected by ice, corrosion, dirt, or normal use; relatch after a fall and not activate inadvertently; not interfere with proper binding function or performance; not be a hazard under non-skiing conditions while the ski is being serviced, transported, or stored; in addition, the ski brake should be easy to install, easy to enter, easy to transport, and be durable without requiring frequent or complicated maintenance.

The ski brakes described in the above mentioned articles have tried it is said to both successfully and unsuccessfully meet these standards. The most common type of ski brake design employs a two pronged, spring-loaded braking arm that lays flat along the ski edge, where it may be damaged in normal use, may interfere with the ski edge, and generally is said to be less effective at stopping the ski in one direction because of the direction of the transverse rotation of both the braking components and their actuating springs. Presently a less common type of ski brake design utilizes a ski brake, which generally rotates through 270° under spring force about a longitudinal axis, from a transverse position below a ski boot, when freed, to a perpendicular position below the edge of the ski to serve as a ski brake.

SUMMARY OF THE INVENTION

This ski brake meets ll the objectives or standards set out in the above mentioned Skiing magazines of October 1975 and October 1976, in both its single or dual braking arm embodiments. The rotation of the braking arm is in a transverse plane of the ski about a longitudinal axis, as opposed to a longitudinal plane about a transverse axis, which assures the braking arm will not pivot during either the forward or backward motion of the released ski, thus providing a certain effective stopping force. Also this type of transverse plane rotation of the braking arm allows the ski to be stopped, if it is sliding sideways. The construction and design of the braking arm and assembly made from a hard, lightweight material, such as aluminum, insures there will be no breakage and the ski will be stopped regardless of slope steepness, snow conditions, or speed. Also aluminum does not corrode. The braking arm is hinged upwardly in a clear position over a ski. This helps insure the ski brake will not be a hazard to the skier or other skiers on the slope during normal skiing maneuvers or operations. The simple spring loaded arm and latching bar assembly provides for easy installation and maintenance and positions the braking arm so it only rotates 180° into its braking position. Also this assembly insures the ski brake is unaffected by weather conditions. In one embodiment the latching bar may be held in the ready position by means of a catch to allow for easy entry. In another embodiment, pre-positioning of the ski binding holds the latching bar in place. The release of the ski boot from the ski binding is the only required motion needed to release the braking arm. Therefore there is no inadvertent triggering of the ski brake when the skier is on his or her skiis. Although the ski brake may be made as an integral part of the ski binding or as a separate assembly, neither type or embodiment of this ski brake mechanism interferes with the normal operation of any ski binding. Also a protective material is placed on the braking arm to protect the ski edge from possible damage.

All the braking arms of any embodiment may have a ski retention strap with one end attached to the braking arm by means of a release mechanism and the other end for attachment to the boot or leg of the skier, so in the event the binding accidently releases while the person is on the chair lift, the ski will be retained and prevented from falling to the ground. Yet the release mechanism used in securing the retention strap to the braking arm will allow the ski during a skiers fall to go free upon the exertion of a force greater than the weight of the ski, so the ski will clear the skier and then will be stopped by the ski brake. Also the securement means used in the ski brake assembly for attachment to a ski or to a ski binding in some embodiments, has several optional fastener receiving holes for adjustable positioning of the ski brake on the ski.

DESCRIPTION OF THE DRAWINGS

Various preferred embodiments of the snow ski brake are illustrated in the drawings wherein.

DESCRIPTION OF PREFERRED EMBODIMENTS

Figure 1:
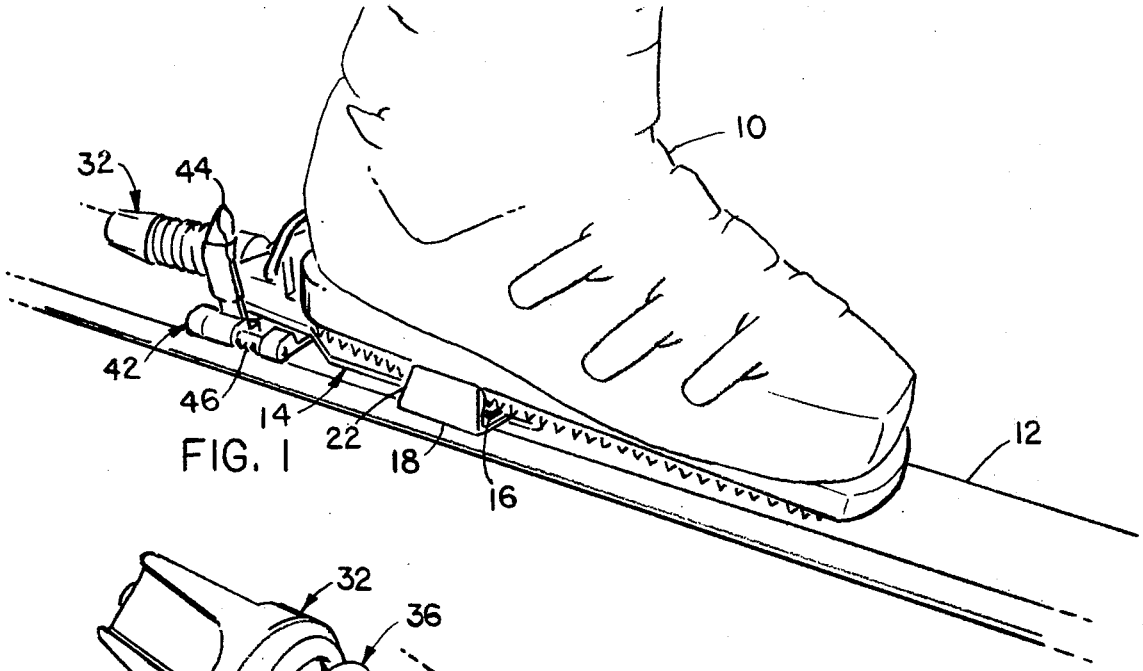
FIG. 1 is a partial perspective view of a skier's boot held in position on a ski by using a "Spademan" ski binding, and indicating the position of a single arm snow ski brake in its ready position.
Figure 2:
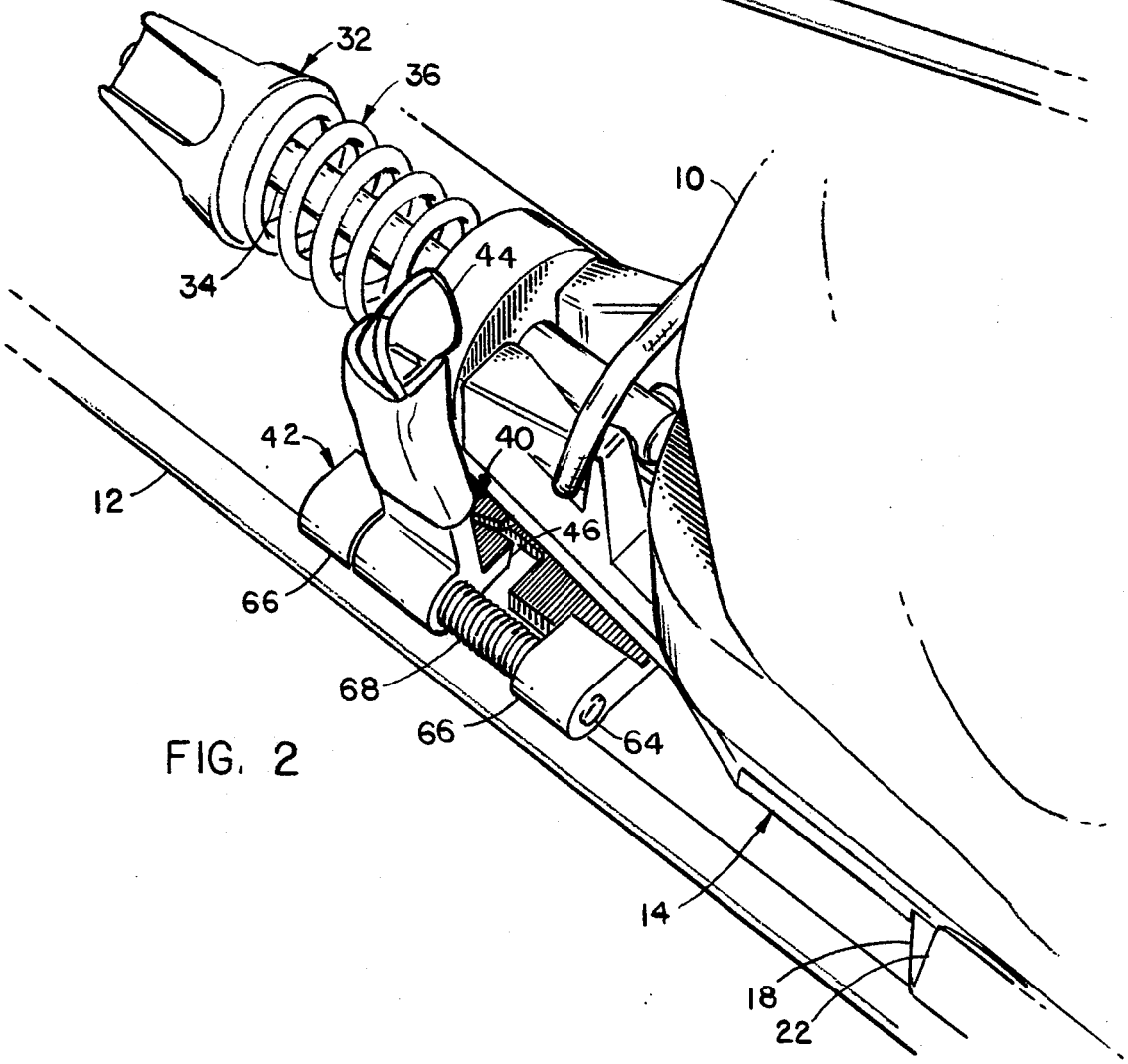
FIG. 2 is an enlarged partial perspective view, very similar to FIG. 1, showing how a portion of the "Spademan" ski binding, during a skiing run retains the latching bar of the ski brake in its ready position.

The Movement of the Braking Arm and Latching Arm of the Ski Brake

In the drawings several embodiments of this snow ski brake are illustrated. Throughout all embodiments, the braking arm rotates through 180° from an upstanding ready position over the ski, at a location to the rear of a heel of a ski boot, into a downwardly projecting braking position perpendicular to the ski bottom. Each snow ski brake has a latching arm integrally secured to it at right angles. In the ready position of the braking arm, the latching arm is laterally or transversely positioned across the ski and adjacent thereto, and the skiers ski boot holds the latching arm in this position against a spring force.

When the ski boot is freed from the ski binding when a skier falls, the latching arm is cleared by the spring action. The rotation of the latching arm occurs about a longitudinal axis, which is parallel to the longitudinal axis of the ski, as does the ski braking arm, which is integral with the latching arm. They both rotate through 180° in changing from the ready to the released ski braking position.

To keep a snow ski brake in a ready position before a skier's boot is inserted into the ski bindings, a spring biased catch is used in some embodiments to hold the latching arm substantially adjacent the ski top, and in another embodiment movable portions of a ski binding are utilized to perform the initial motions of the catch operation.

The Ski Brake Embodiments, Wherein Movable Portions of a "Spademan" Ski Binding Operate a Lever Catch, Which in Alternate Positions, Either Holds the Latching Arm, or Releases it and Hence Operates the Braking Arm In FIGS. 1 through 6, the snow ski brake embodiment is illustrated which utilizes the motions of ski bindings, sold under the tradename "Spademan." In FIG. 1 a ski boot 10 is illustrated mounted on a ski 12 using a "Spademan" ski binding 14. This binding requires a transverse clamping bar 16 to be secured to the bottom of the ski boot 10. The clamping bar 16, when the ski boot binding is tightened, is gripped between movable clamps 18 and 20. As shown in the cutaway portions in FIG. 4, the clamps 18 and 20 of this "Spademan" binding have the ski boot edge grippers 22, and various cam surfaces 24 arranged in reference to its mounting pin 26. Somewhat complimentary mating cam surfaces 28 are used on a central or longitudinal translating slotted actuator bar 39. The movement of this bar 30 is directly related both to the movement of the movable clamps 18, 20, and to the movement of the adjustable tensioning subassembly 32, having a rod 34 pivotally secured to the actuator bar 30, a variable compression spring subassembly 36 arranged about the rod 34, and a subassembly 38 of cam guiding components, serving as the heel end of the "Spademan" binding 14. It is this movement, involving the longitudinal translation of the central slotted actuator bar 30 of the "Spademan" ski binding 14, which moves the movable "Spademan" lamps 18 and 20, that is also utilized to move the catch subassembly 40 of this ski brake embodiment 42.

In FIGS. 1, 2, 4 and 5, ski brake embodiment 42 is illustrated with the braking arm 44 in its ready position over the ski 12 at a location to the rear of the heel of the ski boot 10. Its integral latching arm 46 at its 90° angle is positioned over the ski 12, where it is held captive by the catch subassembly 40 illustrated in the partially exploded views of FIGS. 5 and 6.

Figure 3:
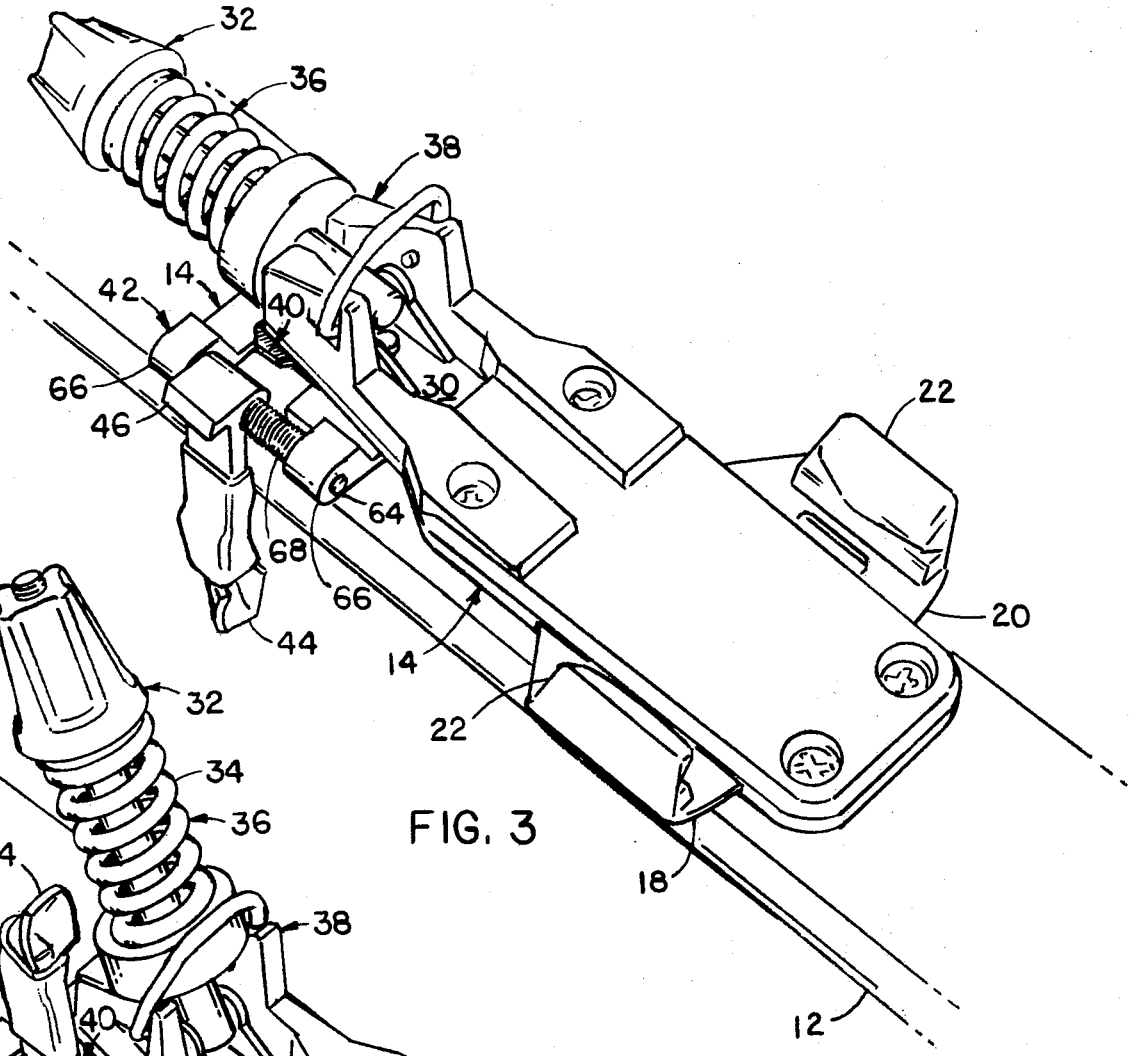
FIG. 3 is a perspective view of a "Spademan" ski binding with the snow ski brake released into its braking position, just after a skier's boot has been released from the "Spademan" binding.
Figure 4:
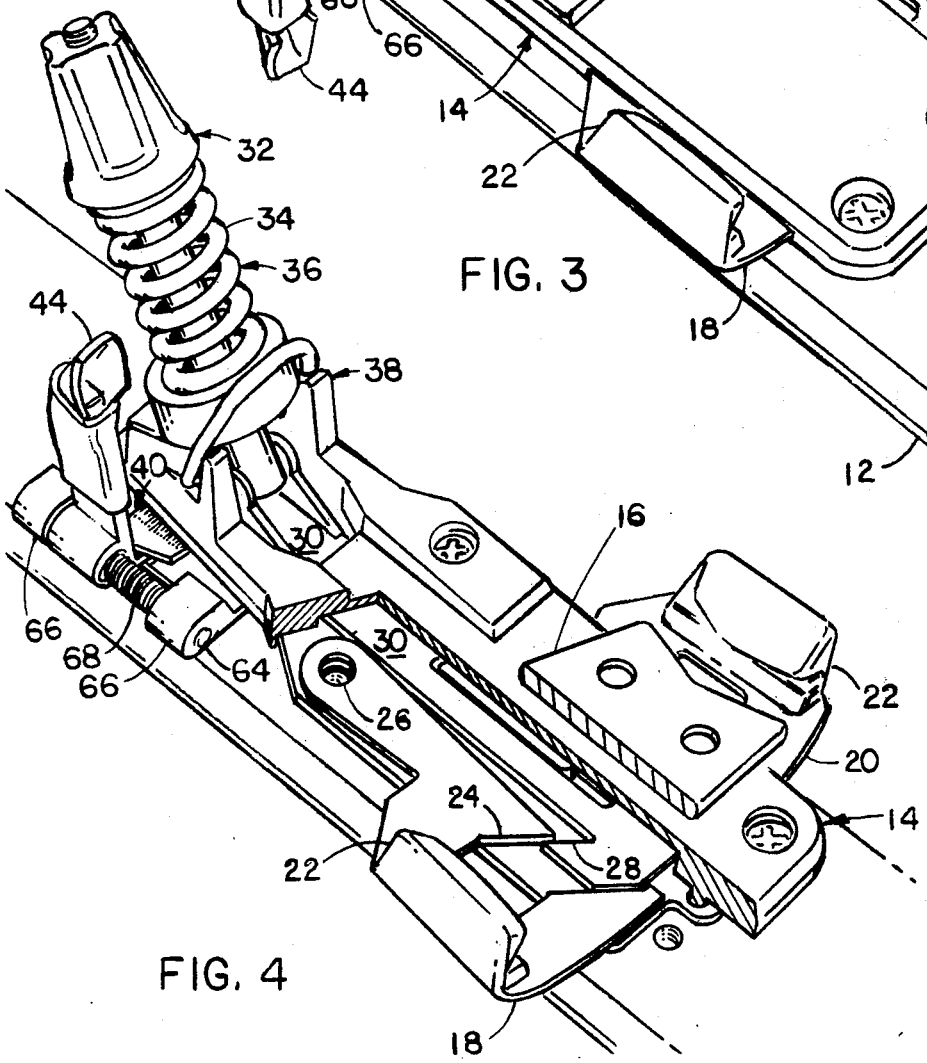
FIG. 4 is a perspective view of a "Spademan" ski binding being readied again by a skier, indicating how the ski brake is held in its ready position; with portions removed of the "Spademan" binding, to indicate how the inner components of the "Spademan" binding when moved to receive the ski boot, also help to latch the ski brake latching bar.
Figure 6:
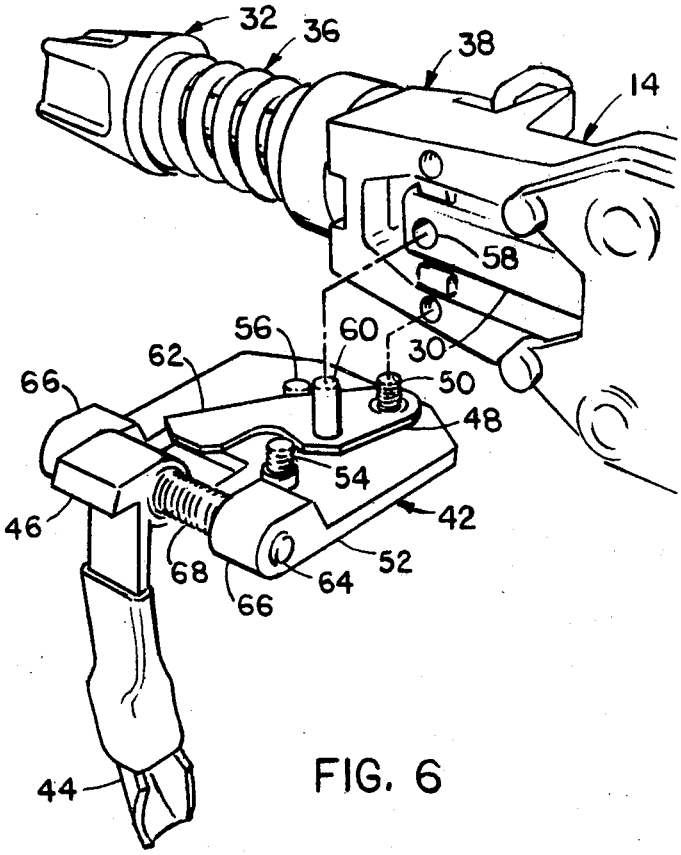

In FIGS. 3 and 6, ski brake embodiment 42 is illustrated with the braking arm 44 in its braking position extending downwardly and perpendicularly alongside of the ski 12. The ski brake 42 quickly, positively, and automatically, goes to this braking position, when a skier falls and his or her ski boot 10 comes out of the binding 14, i.e., the ski boot 10 clears the binding, while the binding was otherwise still in its secured position with the adjustable tensioning subassembly 32 still in its position parallel to the top of the ski 12. During the exit of the ski boot 10, the movable clamps 18, 20 move radially outwardly enough to also axially move the central translating slotted actuator bar 30 of the "Spademan" binding 14.

Figure 5:
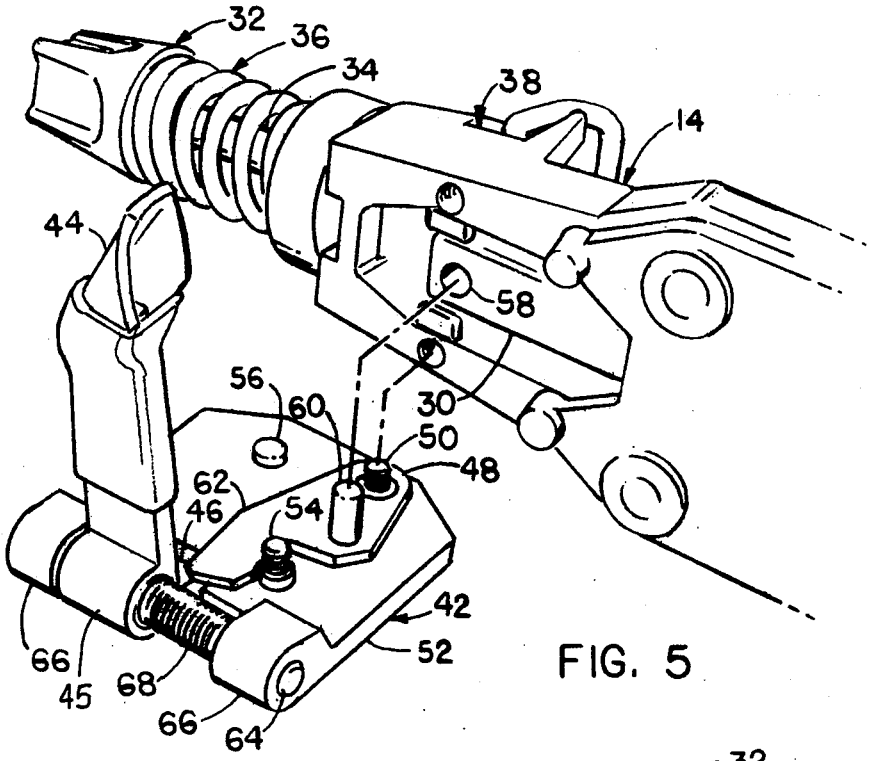
FIGS. 5 and 6, in partial perspective and partially exploded views, indicate respectively the ready position and the braking position of the snow ski brake embodiment used on a "Spademan" ski boot binding.

In FIGS. 5 and 6, the before and after positions of ski brake 42 are illustrated to indicate how its components of the catch subassembly 40 move, upon movement of the central translating slotted actuator bar 30. The pivotal catch arm 48 is pivotally mounted about an installation fastener 50 below the base 52 of the ski brake 42, and limited in its travel by another installation fastener 54 and also a stop abutment 56. Its pivotal movement between these stops 54, 56 is directly caused by the translation movement of the central translating slotted actuator bar 30 of the "Spademan" binding 14. To accomplish this pivotal movement the only change made in an otherwise completed "Spademan" binding 14, in order to transfer the force between these respective components of the "Spademan" binding 14 and the ski brake 42, is the creation of a hole 58 in the central translating slotted actuator bar 30. Then into this hole 58, a pin 60 is inserted, which is integral with the pivotal catch arm 48 at a location near its midpoint.

In FIG. 5, the pivoting end 62 of the pivotal catch arm 48 is positioned over the latching arm 46 of the braking arm 44 keeping it in its ready position. Whereas in FIG. 6, this pivoting end 62 is cleared away and the latching arm 46 and braking arm 44 have rotated 180° into the ski braking position, as also illustrated in FIG. 3. Similar components of opposite hand creating another ski brake 42 are installable on the opposite side of the ski 12 to provide two braking arms 44 for increased stopping power. The braking arms 44 via their integral hollow braking arm hubs 45 are mounted on shafts 64 positioned in bearing structures 66 and driven by the force of coiled springs 68, anchored between the braking arm 44 and base 52.

Figure 7:
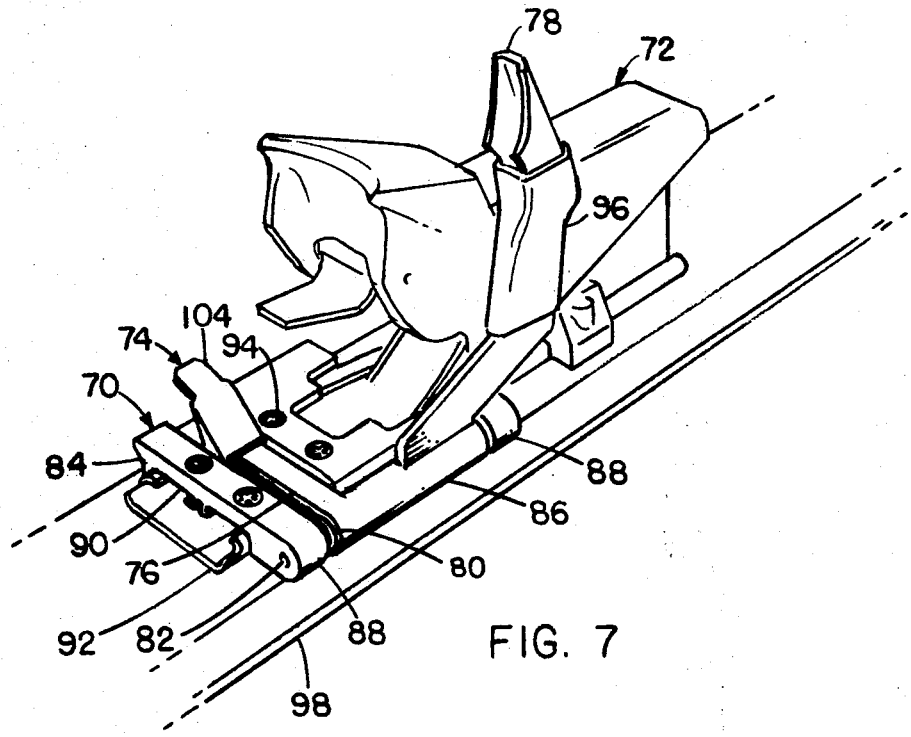
FIG. 7 is a partial perspective view of the heel portion of a "Solomon" ski binding on a ski and the ski brake in its ready position as its latching bar is held by a spring catch, awaiting the entry of the skier's ski boot.
Figure 8:
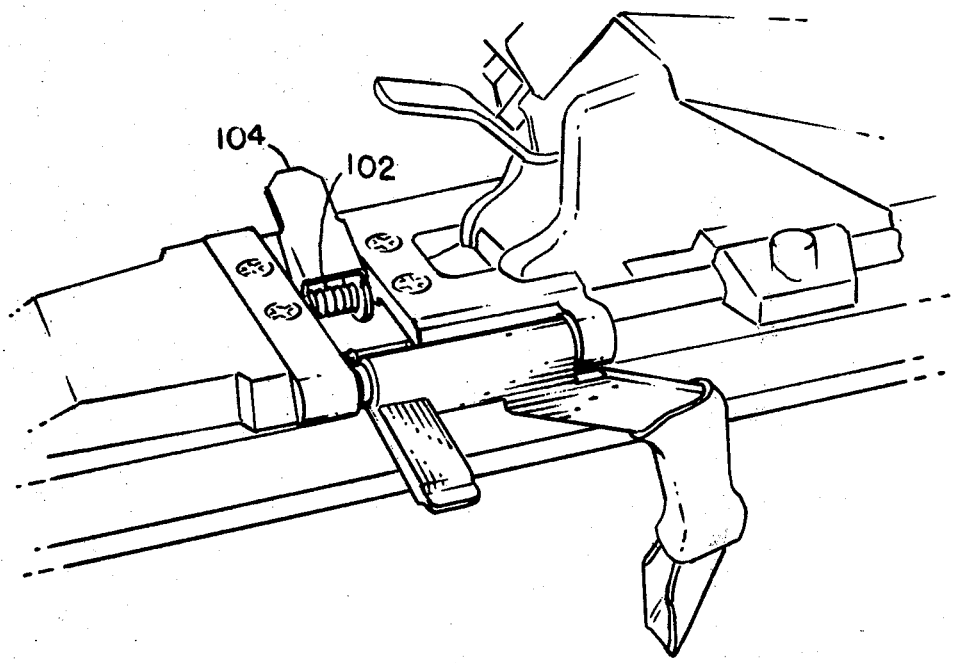
FIG. 8 is a partial perspective view similar to FIG. 7, showing, however, the ski brake in its braking position after the skier's ski boot has been removed.

The Ski Brake Embodiment, for Positioning With a "Solomon" Binding at its Heel, Without Hindrance or Change to the Binding In FIGS. 7 and 8, a ski brake embodiment 70 for positioning with a "Solomon" ski boot binding 72 is illustrated respectively in its ready and braking positions. The ski brake 70 is arranged so the skier's ski boot 10, upon entry of its heel into the "Solomon" binding 72, will depress a spring biased catch subassembly 74 to clear it from retaining the latching arm 76, but at the same time keeping the latching arm 76 in place, by taking over the function of the catch subassembly 76, which is used to keep the ski brake 70 in its ready position when the ski is not being used.

When a skier falls and his or her ski boot 10 clears the "Solomon" binding, there is no further restraint on the latching arm 76 and thereafter both it and the integral braking arm 78 quickly and positively move through 180° into the braking position illustrated in FIG. 8. The power for the quick movement is provided by a coil spring 80 positioned about the shaft 82 and anchored between the base 84 and braking arm 78. This spring is substantially positioned within the integral hollow braking arm hub 86. The shaft 82 is retained in bearing structure 88 of the base 84, which is formed throughout its length on its underside 90 to fit snugly for an endwise positioning on the base member 92 of the "Solomon" binding 72. It is held in position by set screws 94. The braking arm 78 in this embodiment and all other embodiments is equipped with a protector 96, such as rubber sleeve 96, to protect the metal edge 98 of the ski 12.

As illustrated in FIG. 8, the spring biased catch 74 is pivotally secured to the base 92 about a longitudinal shaft surrounded by a coil spring 102, which is anchored between the base 92 and the lever 104 of the catch 74. The spring 102 urges the lever 104 into contact with the latching arm 76, which is then kept in its ready position and therefore the braking arm 78 is also kept in its ready position. Then when the skier steps into the "Solomon" binding 72, his or her ski boot 10, depresses the lever 104 to clear it from the latching arm 76. Yet the latching arm 76 does not release, because thereafter it is held captive by the ski boot 10, until the ski boot 10 is released from the "Solomon" binding 72 during the skier's fall. Such a release occurs if the stresses created during the fall are sufficient to cause such a needed release to avoid any injury to the skier, which would otherwise occur, if the ski 12 were to remain firmly bound to the ski boot 10. When the ski binding release occurs, this ski brake 70 is also promptly released, and the ski 12 is prevented from running away. Also, under the action of the ski brake 70, the ski 12 separates from the falling skier, so the skier will not be hurt by the otherwise flailling ski, if it had otherwise been retained by a retention strap. Such retention straps are now being used, when no ski brake is being utilized, and the ski 12 must be kept from running freely down the hill to possibly seriously injure another skier.

Figure 9:
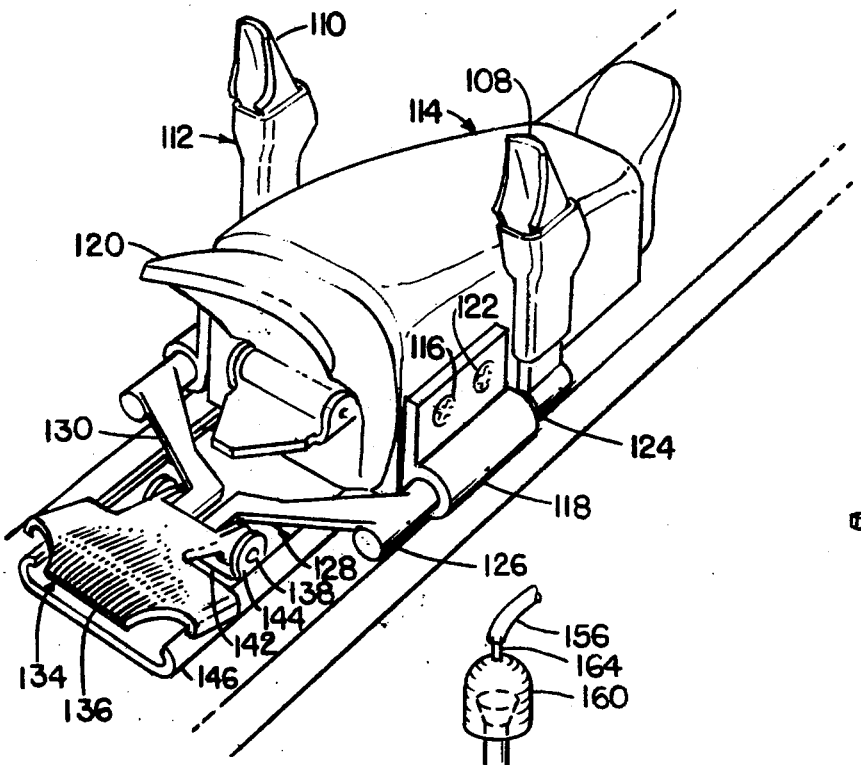
FIG. 9 is a partial perspective view of the heel portion of a binding on a ski and two ski brakes in their ready position as their respective latching bars are both held by a spring catch, awaiting the entry of a skier's boot.

Ski Brake Embodiment for Direct Attachment to Components of a Ski Binding, like the Heel Components of a "Solomon" Ski Boot Binding, and Also the Use of Two Ski Braking Arms In FIG. 9 the installation of two braking arms 108, 110 of opposite hand are illustrated positioned above respective sides of a ski 12 in their ready positions. Such dual use of ski brakes is undertaken, as necessary, in respect to all embodiments in similar ways.

Also illustrated in FIG. 9 is the arrangement of this dual ski brake 112 for its direct attachment to components of a ski binding 114. A combined vertical base 116 and bearing structure 118 is held to the sides of the heel components 120 of the ski binding 114 by fasteners 122. A coil spring 124 is positioned about a shaft 126 and anchored between the shaft 126 and the vertical base 116 to provide the spring force which rotates the respective braking arm 108 or 110 into its braking position. In this embodiment the shaft 126 is integral with both the braking arm 108 or 110 and also the latching arm 128 or 130.

One spring biased catch 134 is arranged, so its lever 136 keeps both latching arms 128, 130, in place, in turn keeping the braking arms 108, 110 in their ready positions. This lever 136 is mounted on a transverse shaft 138 and a coil spring is used in like manner to the coil spring 102 of the spring biased catch 74 illustrated in FIG. 8, to keep the lever 136 in its holding position over the latching arms 128, 130, until the heel of a ski boot 12 is entered into the ski binding 114. A base structure 142 also having bearing structure 144 slides endwise into a base member 146 of the ski boot binding 114, where it is secured, to thereby position the lever 136 of the spring biased catch 134.

As occurs in all embodiments, when a skier falls and his or her ski boot 10 is released and cleared from the ski binding, 114, the latching arms 128, 130 are also cleared quickly and positively, and their respective ski brake arms 108, 110 immediately become effective. Previously the spring biased catch 134 had been released by the heel of the skier's boot 10, when he or she stepped into the ski binding 114.

Figure 10:
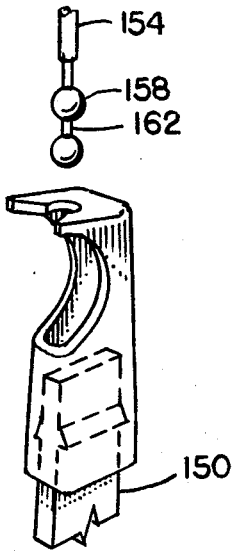
FIGS. 10 and 11, in partial perspective, indicate two different methods of fastening a ski retention strap to the ski brake arm when it is in its ready position.
Figure 11:
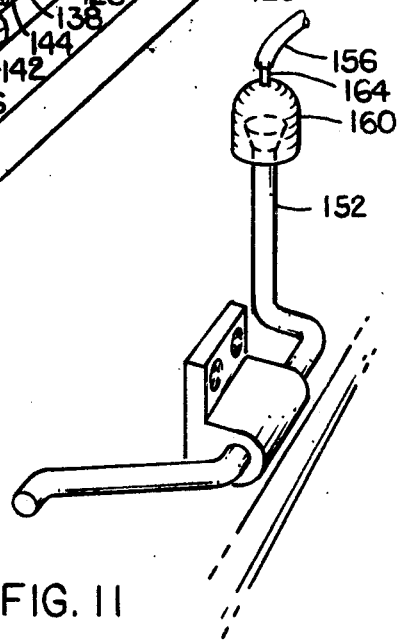

Ski Brake Embodiments to Comply With Continuing Requirement of Retention Straps to be Used During Skier's Chair Lift Rides There remain requirements in many ski areas that ski retention straps be used by skiers riding the chair lifts to avoid the dropping of a ski on a skier skiing below. Therefore to fulfill these requirements, as illustrated in FIGS. 10 and 11, the ski braking arms 150, 152 are modified respectively, as all the ski braking arms of all embodiments could be, to receive retention straps 154, 156, which have end fittings 158, 160, inclusive of breakaway components 162, 164. The latter are strong enough to support a ski 12 inadvertently released during a chair lift ride, but weak enough to fail and to separate when a skier falls and his ski binding releases his boot 10. In this way the ski area's requirements are complied with, yet when a skier falls under circumstances so requiring the ski 12 to be separated from him or her, the ski 12 does leave the skier, yet it is stopped by the action of one or two ski braking arms 150, 152, avoiding its otherwise dangerous runaway down the ski slope.

Also when a breakaway strap is used, when the skier does fall at high speed, the breaking of the breakaway strap does initially and momentarily, effectively retard the ski from an otherwise jet-like departure. The ski brake aided by the breaking of the breakaway strap, then too becomes more effective in stopping the ski and keeping other skiers from being hurt by an otherwise possible jetting ski.

Figure 12:
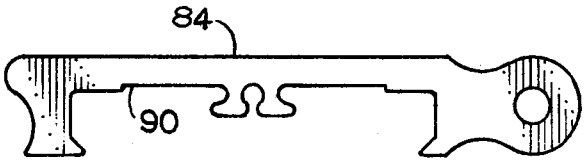
FIGS. 12 and 13, in partial cross-sectional views respectively indicate two embodiments of the base of the ski brake assembly, one to fit over a ski binding and one to fit under a ski binding.

Ski Brake Embodiments to Mount the Respective Ski Brakes on Skiis and/or Their Bindings Without Interfering with the Performance of the Ski or Ski Binding As shown in FIG. 5 and 6, the ski brake 42 for the "Spademan" binding 14 requires only the modification of creating the hole 58 in the binding 14 and not requiring a modification of the ski 12. As illustrated in FIGS. 7 and 8, the ski brake 70 for the "Solomon" binding 72 essentially does not require the changing of the binding 72, because the underside 90 of the base 84 of the ski brake 70 is formed to slide endwise over and partially around the longitudinal edges of the base 92 of binding 72. In FIG. 12 the cross sectional configuration of the base 84 is illustrated.

Figure 13:
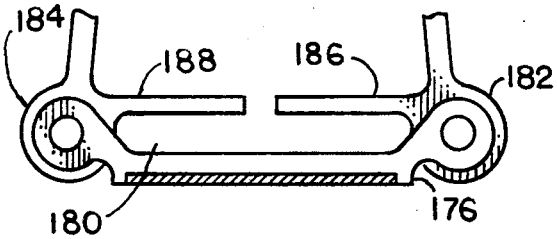

Another embodiment is illustrated in FIG. 13 to show how a base 176 of a ski brake is made for direct placement on the top surface structure of a ski 12, and then any step in ski boot heel binding subassembly fits directly over this base 176. Portions of the ski binding fit through the cross sectional space 180, which is determined underneath by the base 176, along the sides by the hubs 182, 184, and above by the latching arms 186, 188, as depicted in FIG. 13. The skier's boot 12 at its heel, as the skier steps into this ski binding, will rest directly on the latching arms 184, 186, and indirectly on base of the binding, also on the base 176 of the ski brake, and ultimately on the ski running on the snow.

SUMMARY OF THE ADVANTAGES

The various embodiments of this ski brake are believed to meet all of the specifications set forth in the "Skiing" magazine October 1976 issue, page 195, in the article entitled "Go-Ahead for Ski Brakes," and also presented in the Background of this specification. In addition, the various embodiments may include either one or two ski braking arms, which in their ready position do not interfere with the operation of the ski or ski boot bindings, nor project in any snagging or disrupting way during skiing operations. Yet when the braking arms are needed, they immediately rotate 180° into their effective stopping positions below the ski running surfaces, and remain in such position firmly enough not to be distracted from stopping the skiis. They withstand the forces normally encountered on the skiing slopes, and their holding position in the braking position is assured by the stong coil spring and the rotative shaft of the ski brake both being longitudinally orientated in reference to the length of the ski. As necessary, the various embodiments of the ski brake are equipped with retention straps having breakaway portions, which do not break when a ski might be loosened and dangle during a ski lift run uphill, but which do break quickly if a skier falls under any stress conditions requiring the ski to be freed of his or her ski boot. Thereafter the ski is stopped by the ski brake, thereby separating the skier from the ski, yet keeping the ski from running away down the ski slope.

I claim:

1. A snow ski brake to be mounted on a snow ski binding in turn mounted on a snow ski for immediate actuation to stop an otherwise runaway ski from sliding downhill after a ski has been released from a skier's safety automatic release binding, comprising:

(a) a base extending both transversely and longitudinally on a snow ski, having bearing support portions and fastener receiving portions;

(b) an integral braking arm assembly including a hollow braking arm hub, a braking arm, and a latching arm at a right angle to the braking arm;

(c) a shaft rotatable in the bearing support portions of the base and passing through the hollow braking arm hub of the braking arm;

(d) a coiled spring around the shaft and secured between the hollow braking arm hub and the base to rotatably force the integral braking arm assembly into a ski braking position, wherein the braking arm rotates in a geometric plane which is perpendicular to the base and also to a ski, rotating through approximately 180° from an upward vertical position out of the snow to a downward vertical position in the snow, and the integral latching arm rotates in a geometric plane which is perpendicular to the base and also to a ski, rotating through approximately 180° from a horizontal position adjacent the base and just above the ski, to a horizontal position away from the base and ski; and (e) a catch means mounted to the base to keep the latching arm in a horizontal position over the ski and thereby to keep the braking arm in its upward non-braking position, until a ski boot is inserted into a ski binding, with the ski boot thereafter causing the retention of the latching arm, until the ski boot under an abnormal force is released from a skier's safety automatic release binding.

2. A snow ski brake to be mounted on a snow ski binding in turn mounted on a ski as claimed in claim 1, wherein the catch means has a horizontal shaft mounted on the base, a catch mounted on the horizontal shaft to rotate in a vertical geometric plane to over-lie the latching arm, a spring placed about the horizontal shaft and anchored between the base and the catch.

3. A snow ski brake to be mounted on a snow ski binding in turn mounted on a snow ski, as claimed in claim 1, wherein the catch means has a vertical pin mounted on the base, a catch having a hole to fit about the vertical pin and to rotate in a horizontal plane, a pin spaced from its hole to fit into a hole of a releasing member of the skier's safety automatic release binding and thereby to be provided clear of the latching arm when the releasing member then pinned to the catch is moved under an abnormal force to release a ski boot, two spaced stops mounted on a base to limit the horizontal movement of the catch between its positions of being clear of or over the latching arm.

4. A snow ski brake to be mounted on a snow ski binding in turn mounted on a ski, as claimed in claim 2, wherein a ski retention strap is mounted on the upstanding end of the braking arm in its ready position and is available for securement to a skier's leg, and it has a pullaway portion where it is connected to the braking arm which will not release when a ski is inadvertently released from a binding as for example during a chair lift ride, but which will release when an abnormal force occurs to actuate the skier's safety automatic release binding.

5. A snow ski brake to be mounted on a snow ski binding and in turn on a snow ski, as claimed in claim 3, wherein a ski retention strap is mounted on the upstanding end of the braking arm in its ready position and is available for securement to a skier's leg, and it has a pullaway portion where it is connected to the braking arm which will not release when a ski is inadvertently released from a binding as for example during a chair lift ride, but which will release when an abnormal force occurs to actuate the skier's safety automatic release binding.

* * * * *